United States Patent [19]

Ruf et al.

[11] 4,074,507

[45] Feb. 21, 1978

[54] BAG FILLING MACHINE FOR POWDERY MATERIAL

[75] Inventors: Walter Ruf, New City; Harry Edward Rothmann, Valhalla, both of N.Y.

[73] Assignee: St. Regis Paper Company, New York, N.Y.

[21] Appl. No.: 754,176

[22] Filed: Dec. 27, 1976

[51] Int. Cl.[2] ..... B65B 1/32; B65B 43/34

[52] U.S. Cl. ..... 53/59 W; 53/187; 141/83; 141/103; 141/114; 177/123; 177/160

[58] Field of Search ..... 53/59 W, 187, 188, 237, 53/240; 141/83, 103, 114; 177/123, 160

[56] References Cited

U.S. PATENT DOCUMENTS

| | | | |
|---|---|---|---|
| 1,777,227 | 9/1930 | Roth | 177/160 |
| 2,763,458 | 9/1956 | Kindseth | 53/59 W X |
| 2,790,619 | 4/1957 | Schachte | 177/160 X |
| 3,152,622 | 10/1964 | Rothermal | 141/83 |
| 3,498,020 | 3/1970 | Eppenberger | 53/188 X |

*Primary Examiner*—Travis S. McGehee

*Attorney, Agent, or Firm*—Woodling, Krost, Granger & Rust

[57] ABSTRACT

A machine is disclosed to bag powdery material wherein primary and secondary preconditioning chambers are used, having a volume sufficient to give enough time for the powdery material to become de-aerated. This de-aerated powdery material is then supplied to a bulk filling station and a dribble filling station. Bags spouted at the bulk filling station are filled to about 90 percent of their normal capacity and are then moved laterally to the dribble filling station whereat the bags are rapidly filled to a weight close to the desired exact weight and by automatic speed changing means filled to exact weight at a slower rate. The bags are supported at the top by grippers at both filling stations with the calibrated weight scale being actuated by weight on the grippers at the dribble filling station. An auger at the bulk filling station forces the powdery material down into a generally closed bag to force the bag open by the incoming material to thus keep air out of the bag as much as possible. This saves time in the filling of the bags because time need not be spent waiting for the air to escape out of the powdery material in the bag before the bag can be closed and sealed. A vacuum probe may be inserted into the bag while being filled to help this de-aeration. The foregoing abstract is merely a resume of one general application, is not a complete discussion of all principles of operation or applications, and is not to be construed as a limitation on the scope of the claimed subject matter.

26 Claims, 6 Drawing Figures

Fig. 3
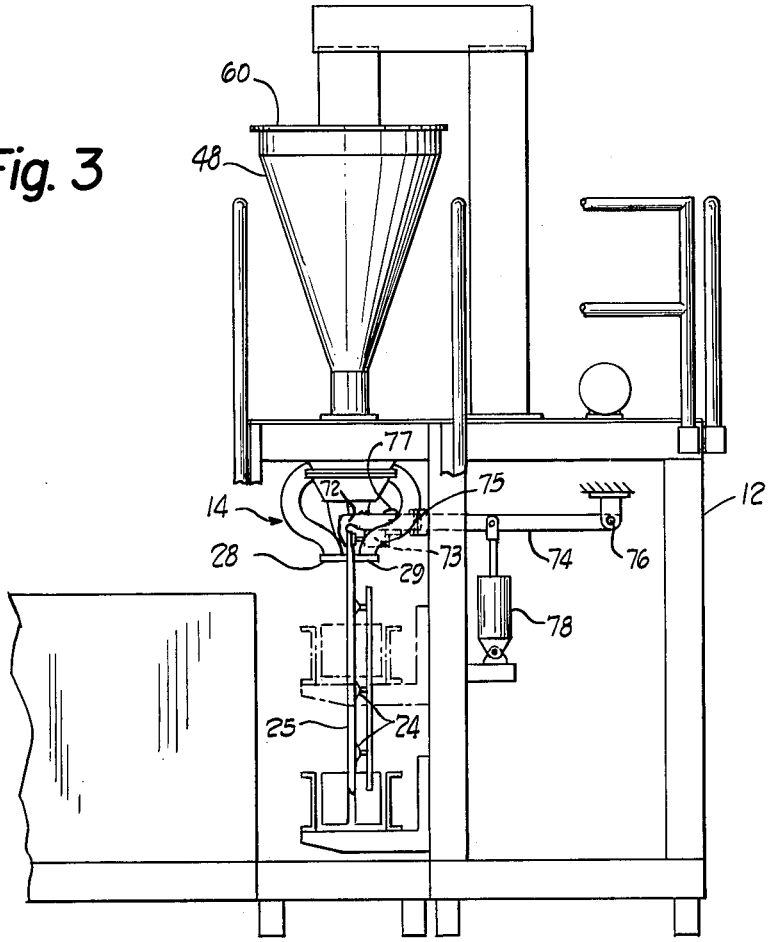
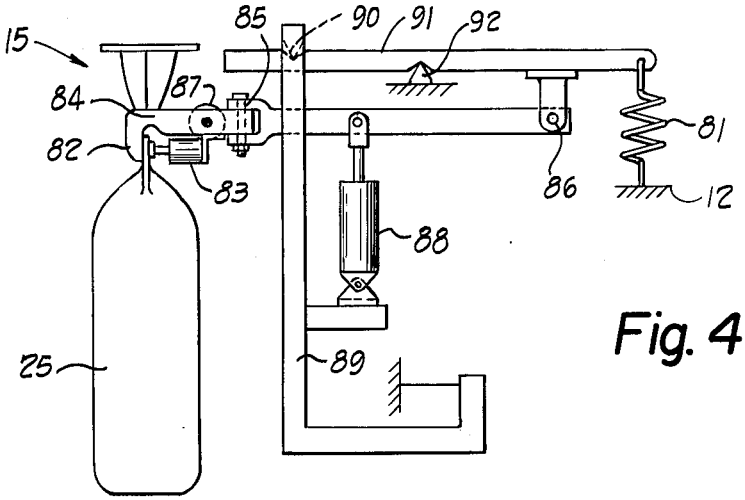
Fig. 4

BAG FILLING MACHINE FOR POWDERY MATERIAL

BACKGROUND OF THE INVENTION

Bag filling machines have been used for many years to avoid the high labor costs in bagging flowable material. In the bagging of powdery material such as flour, the first bags used were burlap or cotton bags. These were permeable to air and hence as the bags were filled air could escape through the pores and of course some of the flour also escaped through the pores. A standard method of filling powdery material into such bags was by the method of filling from the bottom up. A long spout was used and the bag was raised over the entire length of the spout so that the bottom of the spout was near the bottom of the bag. Then as the bag was filled, the bag was lowered more or less in unison with the filling theoretically to fill the bag from the bottom up without much aeration of the powdery material during filling. The industry more recently has gone away from cloth bags to paper kraft bags which are less permeable to air passage but still somewhat permeable. Even more recently barrier bags have been used and these are the type with a plastic liner within the kraft paper outer bag. Such plastic liner does not let the air escape during filling so that it has been difficult to fill bags with powdery material such as powered milk. Another problem is that with powered milk or flour, strict sanitary precautions must be observed. With many prior bag filling machines using a barrier bag, after the plastic liner was filled on the machine, a man had to separately twist together the top of the plastic bag, put a twist tie on it and then tuck this fastened top of the plastic liner down inside the kraft bag. The man's hands would touch the inside of the bag and therefore this was not particularly sanitary. Also it took about four or five men to operate such a bag machine, yet only about two to four 50-pound bags could be filled per minute. One reason for the slow filling procedure was because the 50-pound slug of powdered material would drop through the air and become aerated, and it took time for the air to escape. A certain amount of time had to elapse after the bag was filled to allow the powdered material to settle before the bag could be closed. This limited the productivity of the men and machine.

In some cases with the old machines a sufficient volume of air becomes entrained in the powdery material so that the bag did not have sufficient capacity to initially contain the 50-pound slug of material and the bag would overflow.

Another problem with the prior art bag machine filling systems was that in many cases a 50 thousand pound storage bin was filled so full that the powdery material could not be de-aerated until the level of the powdery material in the bin had dropped to perhaps one quarter full. This is because there was so much weight of material on the material at the bottom that the air could not escape. As a result the material augered from the bottom of this large bin into the funnel shaped bag filling station in the machine would definitely be aerated and hence was aerated as it went into the bags. This aeration was further caused by the dropping from the auger into the funnel which would re-aerate the powdery material even if it was de-aerated at the large storage bin.

Accordingly the problem to be solved is how to increase the productivity of a bag machine and how to prevent as much aeration as possible and also to de-aerate the powdery material before and during the time that it goes into the bags.

SUMMARY OF THE INVENTION

The invention may be incorporated in a bag machine comprising in combination, means to supply bags sequentially to said machine, means to open an openable end of each said bag, primary bulk filling means to fill at a first rate each successive bag with powdery material to a major portion of its normal maximum capacity of material, secondary filling means, first means to shift said majority filled bag to said secondary filling means, means at said secondary filling means to fill said sequentially supplied bags at a second rate, means to support any said bag near the top thereof, calibration means at said secondary filling means connected to said support means to terminate the secondary fill of the bags upon reaching a predetermined calibrated value, sealing and closing means, second means to shift said filled bag to said sealing and closing means, and means at said sealing and closing means to clean inner and outer portions of said filled bag in preparation for sealing and closing the filled bag.

An object of the invention is to provide a bag filling machine with a capability of filling a large number of bags per man hour.

Another object of the invention is to provide a bag filling machine wherein the powdery material is adequately de-aerated before it moves to a bag filling station and is kept in this de-aerated condition.

Another object of the invention is to provide a bag filling machine wherein powdery material is filled into a bag from the top down forcing the bag open to eliminate aerating the powdery material.

Another object of the invention is to provide a bag filling machine wherein a bag is accurately filled to a predetermined weight by a scale connected to grippers supporting the top of the bag.

Other objects and a fuller understanding of the invention may be had by referring to the following description and claims, taken in conjunction with the accompanying drawing.

BRIEF DESCRIPTION OF THE DRAWING

FIG. 3 is an end view of the machine of FIG. 1;

FIG. 4 is an enlarged sectional view on line 4—4 of FIG. 1.

DESCRIPTION OF THE PREFERRED EMBODIMENT

Figure 1:
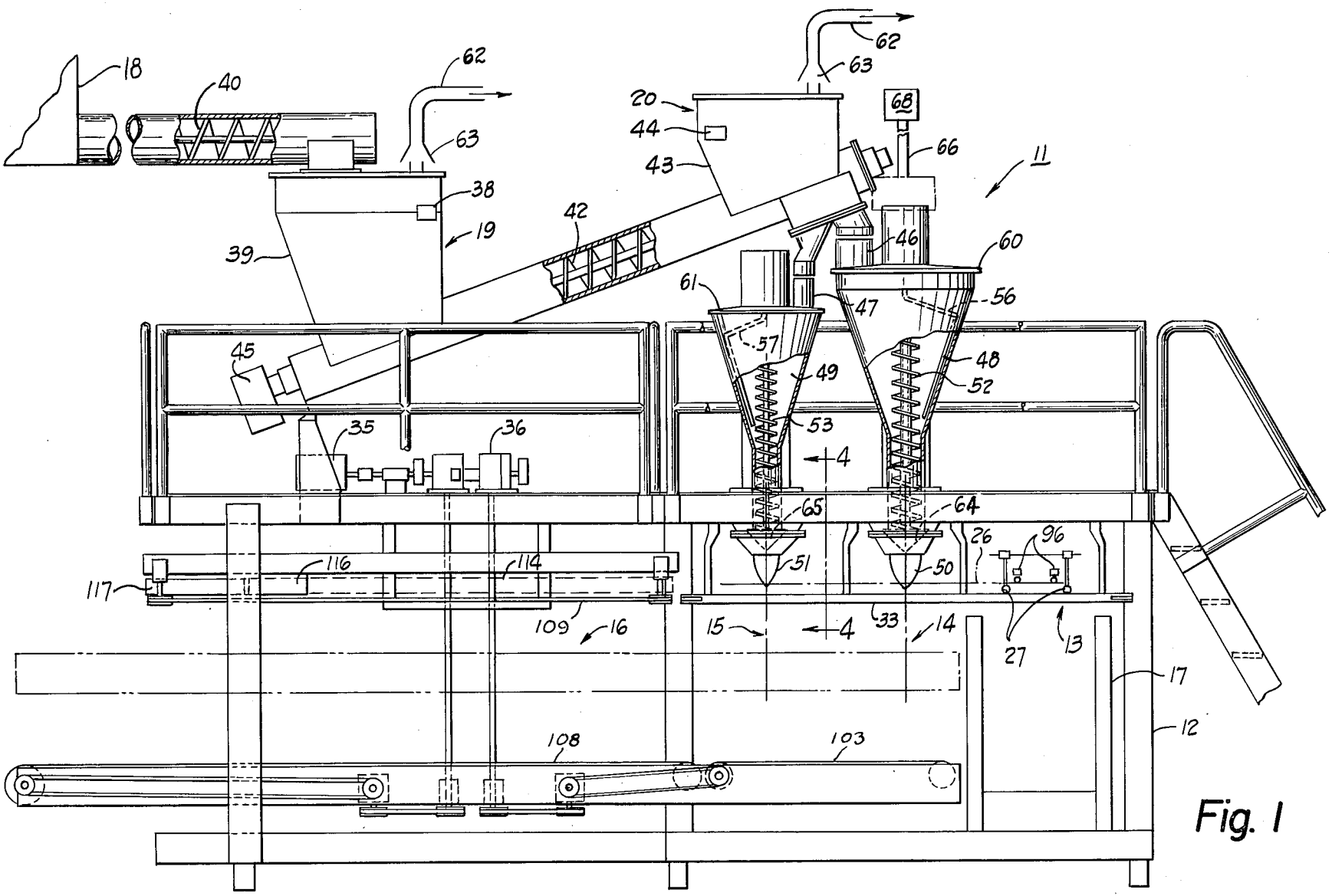
FIG. 1 is a front elevational view of a machine incorporating the invention.
Figure 2:
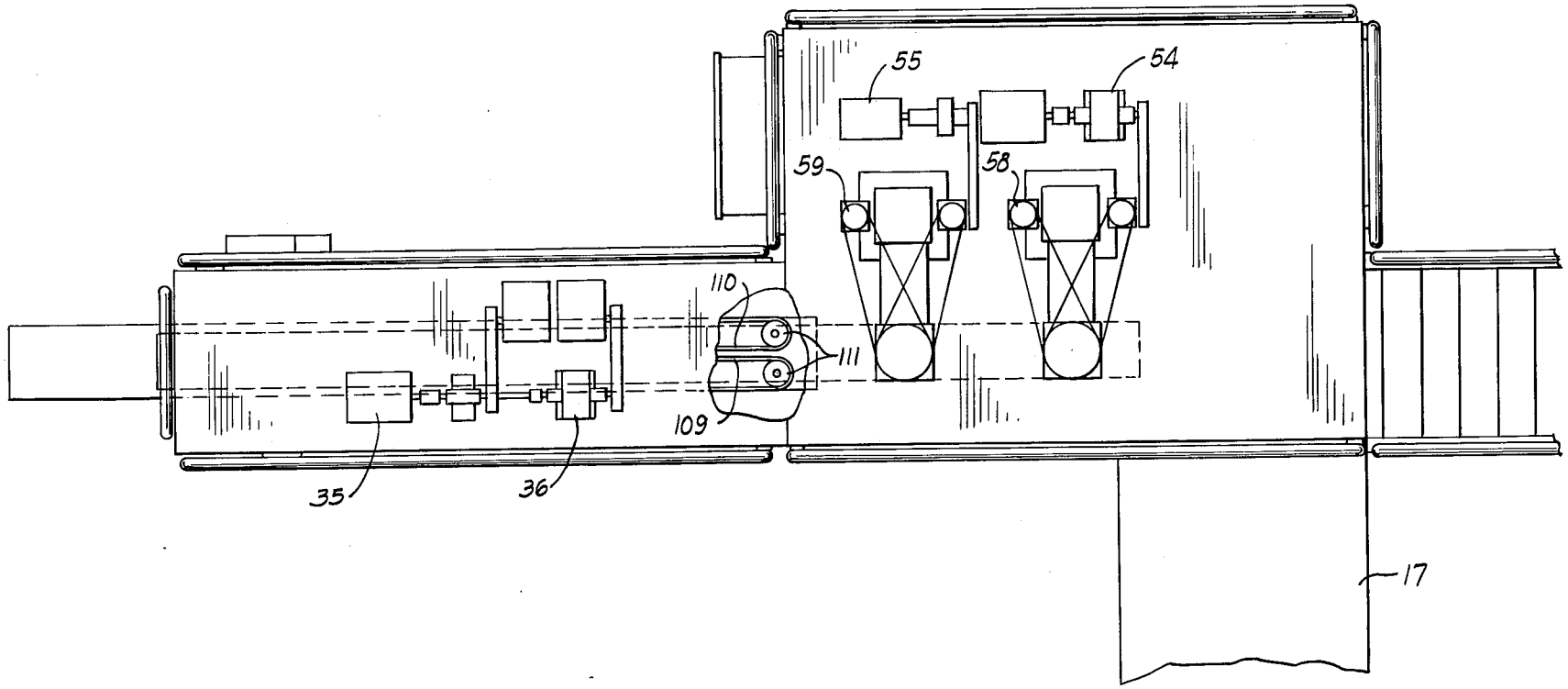
FIG. 2 is a plan view of the machine of FIG. 1.

The figures of the drawing show a bag filling machine 11 incorporating the invention. This machine has a frame 12 on which are mounted generally an alignment station 13, a first bulk filling station 14, a second dribble filling station 15, and a sealing and closing station 16. A magazine 17 is connected to supply bags sequentially to the machine 11. A bulk storage bin 18 may be on the frame 12 or separate therefrom and is connected to supply powdery material to a primary conditioning station 19 which in turn supplies a secondary conditioning station 20 which supplies the powdery material to the first and second filling stations 14 and 15.

Bags are supplied sequentially from the magazine 17 to the alignment station 13 whereat the top edge of each bag is aligned at a reference line 26. Each bag is then moved laterally along the vertical plane of each bag to the bulk filling station 14 whereat the bag receives a major portion of its capacity of powdery material. It then is again shifted laterally to the dribble filling station 15 whereat it receives a minor portion of its capacity to fill the bag to a predetermined calibrated weight as determined by a weight scale operated from the hands or grippers supporting the bag at this dribble filling station 15. The bag next moves to the sealing and closing station 16 to seal and close the bag.

The magazine 17 is adapted to receive the bags standing vertically on their bottom edges with the openable end at the top. A removal mechanism 23 having vacuum cups 24 moves against the end most bag 25 in the magazine 17 and pulls it from the end of the magazine to the vertical plane of the alignment station 13. The removal mechanism 23 then moves the bag upwardly to the horizontal reference line 26 to orient the top openable edge of the bag at this reference line 26. Before said vacuum cups release the bag, the bag is clamped by clamps 27 in the aligned position at reference line 26.

Figure 5:
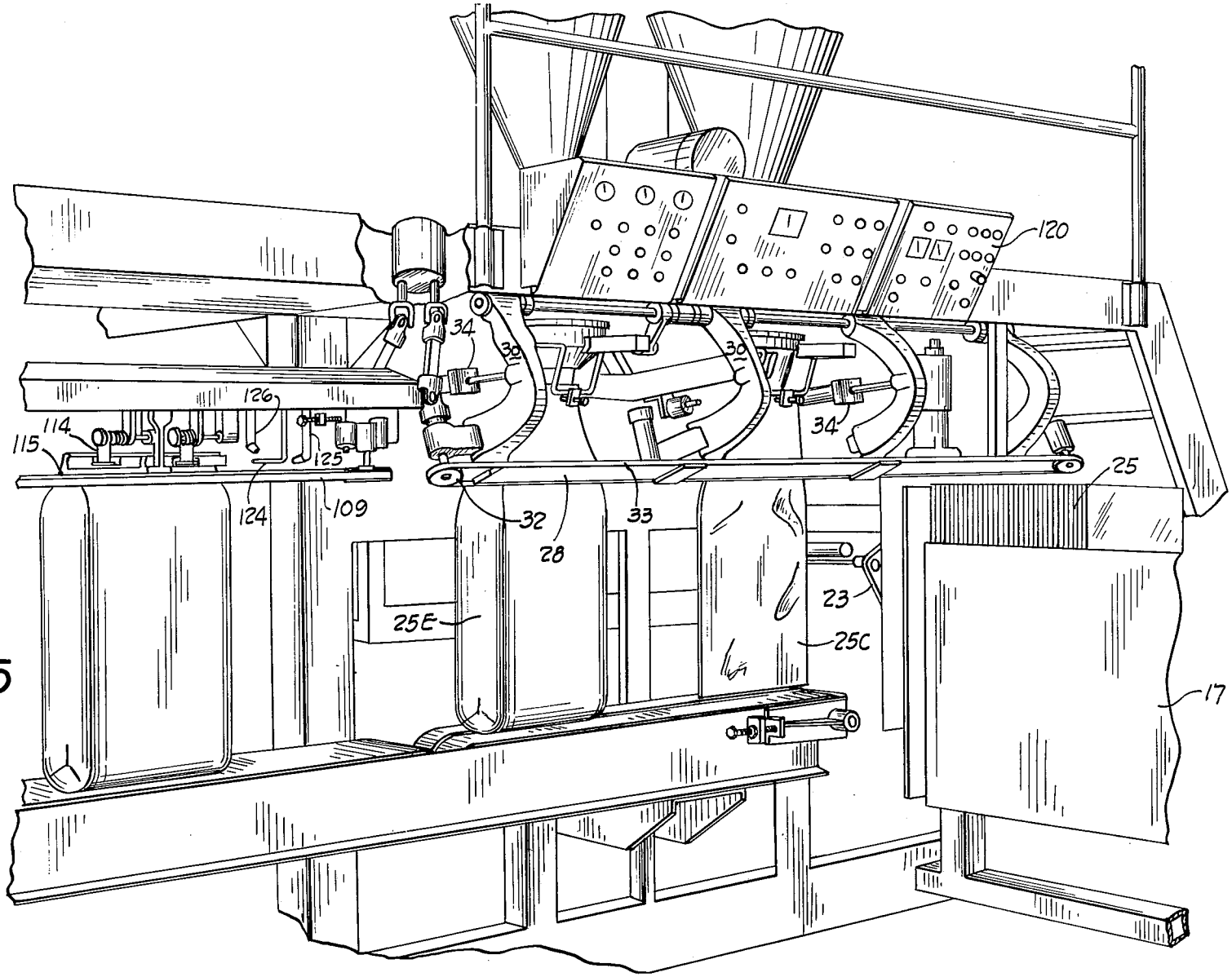
FIG. 5 is a perspective view showing the front of the machine.
Figure 6:
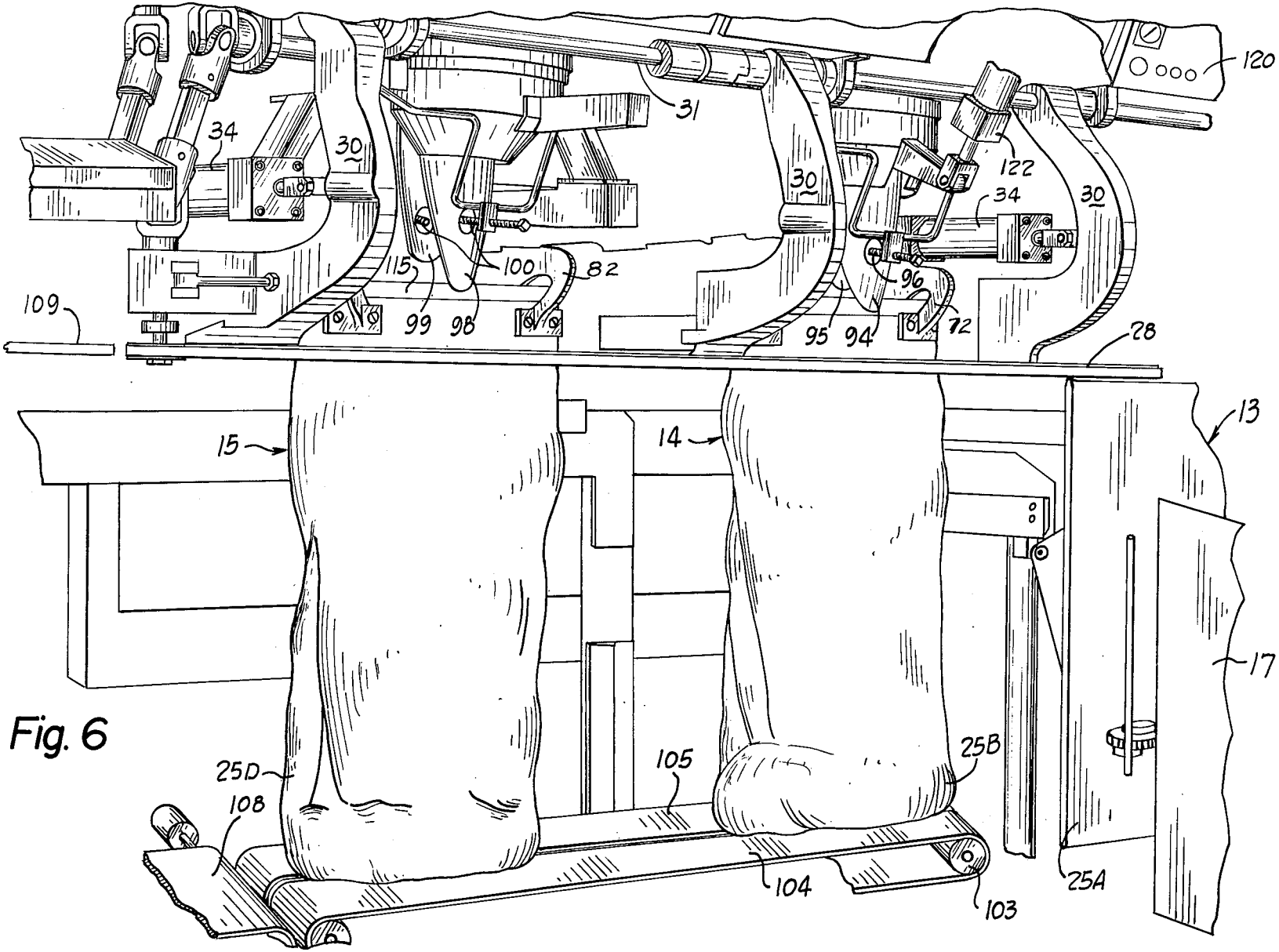
FIG. 6 is a closer perspective view of the front of the machine.

Front and rear movable frames 28 and 29 are shown in FIG. 3 with the front movable frame 28 shown in more detail in FIGS. 5 and 6. These frames are similar and only the front frame 28 will be described. This front frame is supported on four arms 30 which are keyed to a shaft 31 pivoted on the frame 12. The movable frame 28 is mounted on the lower end of these arms 30 and carries movable sprockets and a chain or, as shown, pulleys 32 and a V-belt 33. One or more motors 34, such as expansible fluid motors are connected to the arms 30 to swing the movable frame 28 between the closed position of FIGS. 3 and 6 and an open position as shown in FIG. 5. In the closed position the inboard runs of the V-belts 33 of the front and rear frames will engage the front and rear faces of the bags 25 near the top openable end thereof and maintain alignment of the top of the bag at reference line 26. When the belts of the movable frames 28 and 29 are closed on the bags, as shown in FIGS. 3 and 6, then the clamps 27 are released. A motor 35 acts through a clutch 36, shafts and universal joints to drive the two belts 33 in synchronism so that when the inner runs of the belts are closed on the bag 25, the bag will be moved from the alignment station 13 to the first filling station 14.

The powdery material may be contained in a bulk storage bin 18 which for example may be quite large, 50,000 pounds as an example. The primary conditioning station 19 includes a container 39 which may be immediately below bulk storage bin 18 with an openable valve therebetween which will separate the weight of the material in the bin 18 from the weight of the material in the container 19. Alternatively, as shown, a delivery screw 40 may be connected to deliver the powdery material from the bin 18 to the container 39. The level of material in container 39 is regulated by a level control 38. A second delivery screw 42 is connected to deliver the powdery material from the bottom of the primary conditioning container 39 to the bottom of a secondary conditioning container 43 at the secondary conditioning station 20. This forces the powdery material upwardly into container 43 until a level control 44 is actuated to deactivate the drive 45 of the delivery screw 42. The lower end of the container 43 is connected by conduits 46 and 47, respectively, to first and second bag filling hoppers 48 and 49 at the first and second filling stations 14 and 15, respectively. Both of these hoppers 48 and 49 are funnel shaped with clam shell valves 64 and 65 on the respective lower ends of these hoppers at the discharge outlets, and outer clam shell spouts 50 and 51 surrounding the valves 64 and 65, respectively. Augers 52 and 53 are provided in the hoppers 48 and 49, respectively, and driven by auger motors 54 and 55, respectively. Agitators 56 and 57 are disposed in the hoppers 48 and 49, respectively, and are in the form of stirring rods disposed closely adjacent the conical inside surface of the hoppers. These agitators are driven by agitator motors 58 and 59, respectively. The filling of the container 43 from the bottom up as controlled by the level control 44 means that the conduits 46 and 47 and hoppers 48 and 49 are all full completely to the covers 60 and 61 on the hoppers 48 and 49, respectively. A vacuum line 62 may optionally be connected to the upper portion of the container 39 and 43 through a vacuum break 63 so as to maintain a partial vacuum at the upper volume of these containers 39 and 43. A vacuum probe 66 may be raised and lowered by a motor 68 to extend downwardly through the hollow stem of the auger 52 and into any bag 25 being filled at the first bag filling station 14.

Gripper means are provided to support the bags 25 from a position near the top of the bag. These may be one set of grippers but as shown are two sets of grippers, one set at each of the filling stations. Grippers 72 may be closed by a motor 73 and are supported on arms 74 which have an elbow pivot 75 for horizontal movement and a shoulder pivot 76 for vertical movement with the shoulder pivot 76 being supported on the frame 12. An air cylinder motor 77 extends horizontally between the arms 74 to move the grippers horizontally toward and away from each other. A cylinder motor 78 reacts against the frame 12 to raise and lower the arms 74 and hence raise and lower the grippers 72.

The grippers at the second filling station 15 have an arrangement similar to that at the first filling station 14 but include a scale 81. FIG. 4 shows the gripper arrangement for the second filling station 15 as including grippers 82 which may be opened and closed by a motor 83 and are carried on arms 84 which have an elbow pivot 85 for horizontal movement of the forearm and are supported on a shoulder pivot 86 for vertical movement of the arms 84 and grippers 82. A motor such as an air cylinder motor 87 is connected between the forearms to move these arms 84 toward and away from each other. A motor such as an air cylinder motor 88 is connected to raise and lower the arms 84. The motor 88 reacts against a movable frame 89 which is pivoted at 90 to a beam 91, pivoted at 92 to the frame 12. A load cell may act as the scale 81 and connects the rear of the beam 91 to the fixed frame 12. Thus as a bag 25, carried by the grippers 82, is filled with powdery material, the beam 91 tends to tip counter clockwise as viewed in FIG. 4 and this is resisted by the load cell 81 to weigh the bag and its contents.

At the first filling station 14, the outer clam shell spout 50 has front and rear halves 94 and 95 which may be closed to facilitate spouting of the bag and opened to open the bag top and to allow material to flow into the bag 25. Bag sensors 96 pivoted relative to the front and rear clam shell halves 94 and 95 determine whether or not a bag has been positioned on the spout 50 so that material will not be discharged with a bag being absent or improperly spouted. The second filling station 15 has a similar arrangement with an outer front clam shell 98 and outer rear clam shell 99 being also openable and closeable to facilitate respouting of the bag, and front and rear sensors 100 are pivoted relative to the outer front and rear clam shell halves to detect the presence or absence of a bag or an improperly spouted bag.

A split belt conveyor 103 has belts 104 and 105 spaced slightly apart and this conveyor is positioned below the first and second filling stations 14 and 15. The space between the belts 104 and 105 is to permit the empty, flat bag to move from the alignment station 13 to the first filling station 14 with the bag in this space between the belts. Later the bags may be lifted onto the spout 50 as shown in FIG. 5 and then filled and after filling they will be lowered onto both belts 104 and 105 to be supported thereby.

The sealing and closing station 16 has a conveyor 108 which is a single belt conveyor on the same level as the conveyor belts 104, 105. All of these conveyors may be raised and lowered as shown in the phantom position of FIG. 3 in order to accommodate bags of different dimensions, for example bags of from 25 to 110 pound capacity. The sealing and closing station 16 also has a supporting V-belt 109 at the front and a V-belt 110 at the rear riding on pulleys 111 and driven by a motor 35. These V-belts provide support to hold the bag in a vertical position so it will not tip over and to maintain the top edge of the bag at the reference line 26. The motor 35 drives all bag transport means in synchronism so that bags are conveyed throughout at a constant rate.

The sealing and closing station has means to open the top of the bags to expose inner heat-sealable material areas for air-blast cleaning of such areas in preparation for heat-sealing of bags. A wire 124 pushes back the longer rear lip 115 of bag 25 above the part of the bag held closed by belts 109, 110 and a downstream air jet 125 and an upstream air jet 126 blow on the inside of the front lip and rear lip 115 to clean them of any powdery residue. By this air-blast cleaning of the front and rear lips of bags prior to sealing, the bag top is closed securely. Also the sealing and closing station has means to heat-seal inner heat-sealable materials of such bags for protection of bag contents from deleterious effects caused by absorption of moisture, etc. during storage.

The sealing and closing station 16 also has means 114 to fold over the longer rear lip 115 of the bag 25 which carries a heat sensitive adhesive and which is then carried over a vented plenum chamber where controlled, heated air is impinged on the adhesive to activate it after which the folding of the flap is completed by means which bring it in contact with the adjacent area of the bag to which it seals itself under influence of compression belts 117 which impress on the folded top securing the folded flap. Control means 120 is provided including a control panel mounted so as to be accessible to a machine attendant and which contains all controls necessary for proper functioning of the machine. The various control and limit switches such as the bag sensors 96 and 100 are connected into this control means and control the various motors in a sequence of operation.

OPERATION

The bag filling machine 11 is usable with most any solid particulate or flowable material and is particularly advantageous with powdery material of the nature of foodstuffs such as dried milk or flour or other powdery materials such as may be manufactured by various industries. The powdery material will be present in the bulk storage bin 18 and supplied by the delivery screw 40 to the primary conditioning station 19 equipped with level controls 38. Container 39 has sides converging toward delivery screw 42 which further conveys material to hoppers 48 and 49 and the secondary conditioning station 20 which is thus filled from the bottom up and the product level therein is controlled by level controls 44. It can be seen that when the level of product in the secondary conditioning station 20 reaches a preset maximum as determined by level control 44, screw 42 will be stopped allowing screw 40 to fill the primary conditioning station 39 until stopped by its level control 38. The entire system thus filled contains sufficient product so as to allow time for air to be dissipated from the powdery material even while material is being withdrawn at the bulk and dribble auger stations during operation. Dissipation of air is aided by the partial vacuum established by the vacuum line 62 above both conditioning containers. This is also aided by the agitators 56 and 57 to make certain that no pockets of air might be trapped inside these hoppers 48 and 49. The amount of powdery material thus stored within this conditioning system has a definite advantage. The advantage being that time is permitted in this conditioning system to substantially completely de-aerate the powdery material.

The height of the material in the container 39 to the level set by the level control 38 is in the order of the height of a bag being filled and is approximately one to two times the height of such bag. It has been discovered that material in a bulk storage bin such as the bin 18 often may be stored in such a large vertical dimension that the sheer weight and compaction of the material prevents air from escaping from the powdery material near the bottom. Thus when it was delivered as by a mechanism such as a delivery screw 40, it still was in the an aerated condition. If it was supplied directly to bag filling hoppers similar to hoppers 48 and 49 and then supplied into the bags, these prior art machines often delivered aerated powdery material. Thus the primary conditioning system gives time for the air to escape from this powdery material by the temporary storage in a relatively small quantity at a relatively small vertical height of material. In the prior art machines with the aerated powdery material delivered to the bags, time was necessary for the material to settle in the bag and let the air out of the material before the bag could be sealed and closed. This severely restricted the productivity of the prior art bag machines. In severe cases it was often found that the delivery of the material to the bags had to be slowed or left uncompleted because the bag simply did not have enough capacity to contain all the material, it might overflow before it had reached the required weight.

Bags 25 are supplied by the magazine 17. The removal mechanism 23 pulls off one bag at a time from the rear end of the magazine 17 and moves it to the vertical plane beneath the horizontal reference line 26. The removal mechanism 23 then moves the bag upwardly until the top openable edge of the bag is at this reference line 26. Provided the bag top is level with respect to reference line 26 as determined by two cooperating sensors, which must both engage the bag top, the bag is then clamped in this attitude by clamps 27. At this time the vacuum cups 24 may release their hold on the bag. At this time the control means 120 actuates the motors 34 to close the V-belts on the bag 25 in the position 25A at the alignment station 13, see FIG. 6. The control means 120 then actuates a clutch 36 to move the belts and advance the bag from the alignment position 25A to a position 25B at the first or bulk filling station 14. In this advancing movement the bottom of the bag moves into the space between the belts 104 and 105, also driven thru clutch 36. Motors 73 are actuated so that the grippers 72 grip over the top corners of the bag 25. The bag has been maintained with the top edge in the horizontal reference line 26 by the V-belts 33 so that the grippers 72 grasp successive bags at the same horizontal reference line position. The motors 34 then swing the belts 33 away from the bag because it is now being held by the grippers 72. The bag is in a position similar to the position 25B shown in FIG. 6, except the bag is not filled at this point in time.

Next the front and rear outer clam shells 94 and 95 are closed and because the front outer clam shell 94 is longer it strikes the upwardly extending rear lip 115 of the bag and pushes it backwardly despite the urging of the air cylinder 77 which urges apart the arms 74. This creates a positive opening between the front and rear faces of the bag 25. Next the air pressure is released on motor 77 and motor 78 lifts the arms 74 and hence a closed outer clam shell spout 50 penetrates between the front and rear faces of the bag. The grippers 72 are lifted sufficiently to positively spout the bag 25 on the outer clam shell spout 50 to the position 25C shown in FIG. 5.

The released air pressure on air motor 77 during this upward movement of the bag permits the arms 74 to move together slightly as necessary to permit the bag to be raised upwardly on the outer clam shell spout without stressing the bag.

When the bag is thus raised onto the outer clam shell spout air motor 122 causes the two halves of the outer clam shell spout to open in preparation for filling the bag. At this time, also, sensors 96 are either engaged or not depending on whether or not the bag has been properly positioned and is ready to receive a charge of material. The bag thus spouted remains almost completely closed because it is a side gusseted bag and because the grippers 72, clamped on these gussets, prevent the opening of the gussets at the top and hence restrain the opening of the entire bag. This opening of the bag top around the outer clam shell spout 50 is the extent to which the bag is open, thus there is a minimum of air volume inside the bag at this time.

Next the auger 52 is driven by the motor 54 and the clam shell valve 64 opens to bulk fill the bag in the position 25C as supported by the grippers 72. A major portion of the nominal capacity of the bag is forced downwardly into the bag at this bulk filling station 14. The auger 52 may be a large diameter single pitch thread auger to rapidly fill the bag to about 90 percent of its nominal capacity, for example. The substantially completely de-aerated powder material is forced downwardly into the bag and this is what opens the bag, thus precluding the entrance of practically all air into the bag. Thus the bag is filled from the top down by being forced thereinto by the auger 52. This auger may be a large diameter for example approximating one third the width of the bag. In one machine constructed in accordance with the invention the auger was 5 inches in diameter for a bag of about 15 inches in width which might hold 50 pounds of material. As an option, the vacuum probe 66 may be lowered into the bag through the hollow stem of the auger 52. This vacuum probe is a tube with a porous material along its length so that it will evacuate any air which might tend to be within the material in the bag. This vacuum probe is lowered by the motor 68 and is withdrawn just before the inner clam shell valve 64 is closed. After the slug of material filling the major portion of the capacity of the bag has been forced into the bag, the auger 52 is stopped and the inner clam shell valve 64 is closed. The grippers 72 are lowered by the motor 78 so that the nearly filled bag rests on the two belts 104 and 105 in position 25B shown in FIG. 6, with the top edge of the bag aligned with respect to reference line 26. The motor 34 for the arms 30 are actuated to close the V-belts on the top portion of the bag maintaining the top of the bag on reference line 26 and then the motor 73 releases the grippers 72. The V-belts 33 then may be actuated at the same time that the conveyor 104, 105 is actuated to move the nearly filled bag from the first to the second filling station.

At the second filling station 15, the motors 83 are actuated so that the grippers grip over the top corners of the bag in a position 25D, see FIG. 6. The grippers grip the gussets to keep these gussets closed and to maintain the top edge of the bag at this same reference line 26. The V-belts 33 are then actuated to move away from the bag. The outer clam shell spout 51 is then actuated closed so that the outer front clam shell 98 engages and pushes rearwardly the upwardly extending rear lip 115 of the bag to slightly open the bag. The motor 87 is then deactivated to remove the outwardly urging force between the two arms 84. Motor 88 is actuated to raise the arms 84, grippers 82 and the nearly filled bag upwardly to the position 25E shown in FIG. 5. This is the position with the openable end of the bag received on the outer clam shell spout 51.

The auger motor 55 is a two speed motor and it is started in the high speed position to drive auger 53 at the same time that the inner clam shell valve 65 opens. This is a dribble fill or secondary fill of the bag which will relatively rapidly fill the bag to a predetermined calibrated value, in this case the value is the weight of the bag and contents. When the bag reaches a predetermined value, for example, about 99 percent full, then the motor 55 is actuated to a second slower speed condition for a final topping off of the contents within the bag. When the load cell or scale 81 reaches the predetermined value, this stops the auger drive motor 55 and closes the inner clam shell valve 65 to maintain this precise weight of the bag and contents. This final filling of the bag at the position 25E takes place at approximately the same time as the bulk filling of the next sequential bag at the first filling station 14, so that a continuous process of filling bags is being achieved by the machine 11.

The motor 88 then lowers the arms 84 and grippers 82 so that the completely filled bag rests on the conveyor belts 104 and 105 with the top edge of the bag aligned with respect to reference line 26. This will be the position as shown in FIG. 6. Next the V-belts 33 are moved inwardly by the motors 34 so as to maintain the top edge of the bags at the reference line 26. The motors 83 release the grippers 82 and the conveyor 103 is actuated along with the drive of the V-belts 33 to move the completely filled bag off the end of the conveyor 103 onto the conveyor 108. This conveyor 108 is driven continuously by motor 35 so as to transport the now filled bag throughout the sealing and closing device. Also belts 109, 110 are being driven, continuously and in synchronism to receive and movingly support the top of the bag at the reference line 26. The filled bag then moves into the bag cleaning and sealing means 114 whereat the top of the bag is partially opened and subject to a "scrubbing" action by high pressure air jets directed onto the inner heat-sealable areas of the bag and the top rear lip, having thereon a heat sensitive adhesive, for the purpose of removing excess dust which might impair the security of heat-seals and/or secure bag closure. Next, in sequence, the bag passes through a series of spring-loaded heated platens where the inner heat-sealable material is sealed and a set of compression rolls the purpose of which is to set the seal. Continued movement of the bag on conveyor 108 moves the bag through the bag closing means 116 whereat the longer rear lip 115 is partially folded over, the adhesive thereon is activated by heat, the lip folding completed and the resulting bag closure secured by the compression belts 117.

The present machine is considerably superior to the prior art machines which took a long time and considerable man hours in order to fill powdery material into bags. The prior art machines were attempting to fill bags with powdery material which was aerated and hence a considerable amount of time was required for the powdery material to settle within the bag before the bag could be closed. In the present case the amount of air entrained in the powdery material is kept to a minimum because of the primary and secondary conditioning stations 19 and 20. Also by forcing the powdery material down into the nearly completely closed bag at the bulk filling station 14, a minimum of air is introduced into the bag at this time. The prior art machines attempted to fill from the bottom up, but in order to fill from the bottom up, the bag had to be completely opened and inserted upwardly over a long spout which reached to the bottom of the bag. This meant that the bag was substantially completely open and full of air. Then when the powdery material was dropped into the bottom of the bag, it was aerated by this dropping in addition to having possibly also been aerated before or during the time that it was introduced into the bag filling hopper. The present invention eliminates this nuisance of having aerated material in the bag and thus achieves a considerably greater productivity per machine and per man hour.

Many different types of bags may be used on this machine. Pinch bottom bags are shown. These are bags which have gussets along the full length of the sides caused by a folding of the material hence are termed folded-side-gusseted bags. Square bottom bags may also be used which are side gusseted or flat-type bags may also be used which are not side gusseted because in each case the grippers 72 and 82 grip over the sides of the bag to maintain them closed and thus form restraining means to restrain the opening movement of the bag until the bag is forced open by the entrance of the powdery material. Barrier bags may also be used namely those of a kraft paper outer bag with a plastic liner as a barrier to moisture and entrance of vermin and the like where foodstuffs are being bagged. The barrier or plastic liner may be of many types either permanently, semipermanently, or partially attached to the interior of the kraft outer bag. The V-belts 33 and V-belts 109, 110 act as clamping conveyor means engaging the flat faces of the bags just below the level of the grippers 72 and 82 to maintain the bag upright during the lateral shifting and to maintain the top lip of the bag always in alignment at the reference line 26. This lateral shifting is effected by the first shifting means or conveyor 103 as the primary supporting and conveying means of the bags. The grippers 72 and 82 of course grasp the bag above the level of these V-belts 33 and 109, 110. It will also be noted that the motor 78 is an actuator means to relatively bring together the bag and the outer clam shell spout at the bag filling station. In the preferred embodiment illustrated this relative movement is caused by a raising of the bag onto the outer clam shell spout. Several forms of powered supply means supplying the powdery material to the bags may be provided, and in the preferred embodiment this powered supply means are the augers 52 and 53.

The actuator means also includes the grippers 72 and 82 and because these grippers grasp the side gussets of the bags they act as restraining means restraining opening of the bag against the forced opening by the entry of the powdery material.

The primary and secondary conditioning stations 19 and 20 comprise a de-aeration means to substantially de-aerate the powdery material. The material is supplied to and stays for a sufficiently long time period in each of the containers 39 and 43 and at a sufficiently small vertical height of material so that any air therein is permitted to gradually escape from this material. Also the delivery screw 42 once hoppers 48 and 49 are initially filled, forces the powdered material upwardly from the bottom up into the container 43 and thus it does not have a chance to fall downwardly out of the end of this delivery screw, as in the prior art machines, and hence the powdery material does not become again aerated.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A bag machine comprising in combination,
means to supply bags sequentially to said machine,
means to open an openable end of each said bag,
primary bulk filling means to fill at a first rate each successive bag with powdery material to a major portion of its nominal maximum capacity of material,
secondary filling means,
first means to shift said majority filled bag to said secondary filling means,
means at said secondary filling means to fill said sequentially supplied bags at a second rate,
means to support any said bag near the top thereof,
calibration means at said secondary filling means connected to said support means to terminate the secondary fill of the bags upon reaching a predetermined calibrated value,
closing means,
second means to shift said filled bag to said closing means,
and means at said closing means to close said filled bag.

2. A bag machine as set forth in claim 1, including a two speed drive for said secondary filling means, means responsive to a first value recorded by said calibration means to terminate a higher speed and establish a second lower speed of said drive means, and said second speed being controlled by said calibration means and terminated upon said secondary fill reaching said predetermined calibrated value.

3. A bag machine as set forth in claim 1, including means to assure the top of each bag is aligned with respect to an established reference line and to maintain this alignment throughout the various sequences of operation.

4. A bag machine as set forth in claim 1, including means to open the top of said bag, and air jet means directed to blow air on the interior surfaces of the top of the bag to clean such surfaces prior to closing of the top of the bag.

5. A bag machine as set forth in claim 3, including first grippers to grip a bag near the top thereof at said primary bulk filling means, and to retain alignment of the top of each bag with respect to said established reference line, clamping conveyor means engaging the flat faces of any said bag below said first grippers and above the bulk filled powdery material in the bag to maintain the bag upright during said shifting by said first shifting means and to retain alignment of the top of each bag with respect to said established reference line.

6. A bag machine as set forth in claim 5, including second grippers at said secondary filling means adapted to grip any said bag above the position of said clamping conveyor means and to retain alignment of the top of each bag with respect to said established reference line.

7. A bag machine as set forth in claim 1, wherein said first filling means includes transport conveyor supporting and laterally shifting the majority filled bag between said filling means, and belt means engaging the two opposite faces of the majority filled bag near the top thereof to maintain such bag upright during said lateral shifting and to retain alignment of the top of each bag with respect to an established reference line.

8. A bag machine as set forth in claim 7, including gripper means to grip the majority filled bag near the top thereof, means to raise said gripper means to raise the bag off the transport conveyor, and said calibration means being connected to said gripper means to weigh the bag while suspended by said gripper means.

9. A bag filling machine comprising in combination, a base, a bag filling station on said base, gripper means carried on said base, actuator means to move said gripper means, said gripper means movable by said actuator means to grip near the top of a bag, a hopper adapted to contain a powdery material and having an outlet, an auger in said hopper, means to control said actuator means to raise said gripper means and any said bag to have an opening of the bag received on said outlet of said hopper, fill control means to control the filling of a bag on said hopper outlet, weighing means responsive to the weight on said gripper means relative to said base, drive means to rotate said auger to move material in said hopper to said outlet, and means responsive to a predetermined weight of said filled bag on said gripper means to actuate said fill control means to stop the filling of any said bag.

10. A bag filling machine as set forth in claim 9, including an initial bag filling station on said base, means at said initial filling station to fill a bag thereat with a powdery material to a major quantity of the maximum capacity of the bag, and means to shift the bag to said first mentioned bag filling station to fill said bag to said predetermined weight.

11. A bag filling machine as set forth in claim 9, wherein said actuator means is controlled to have said gripper means grip over the sides of any said bag to hold said sides closed.

12. A bag filling machine as set forth in claim 11, wherein said actuator means is controlled to have said gripper means grip over the top of any said bag at the top corners thereof.

13. A bag filling machine as set forth in claim 9, including an inner clam shell valve on the bottom of said hopper and an outer clam shell spout surrounding said inner clam shell valve, and wherein said actuator means is controlled to raise said gripper means and raise any said bag therein over said outer clam shell spout.

14. A bag filling machine as set forth in claim 9, wherein said drive means has a first higher speed and a second lower speed, and second means responsive to a predetermined weight of the bag being filled to change from said first to said second speed.

15. A bag filling machine as set forth in claim 14, including said first mentioned means responsive to said predetermined weight of the bag being filled controlling the change from said second slower speed to a stopped condition of said drive means.

16. A bag filling machine for filling bags having mouths comprising, in combination, a base, a bag filling station on said base, a fill spout at said filling station and located to penetrate the mouth of a bag, powered supply means at said filling station in closed communication with said fill spout to drive powdery material through said fill spout and into any said bag, means at said filling station to restrain ready opening of the sides of a bag, and means to control said powered supply means to drive powdery material through said spout and into any said restrained bag to drive the powdery material from the top down into any said bag to gradually force the bag open from the top down against the urging of said restraining means so that the powdery material has a minimum of aeration.

17. A bag filling machine as set forth in claim 16, including actuator means to relatively move said gripper means and said fill spout.

18. A bag filling machine as set forth in claim 16, wherein said restraining means includes gripper means to grasp any said bag.

19. A bag filling machine as set forth in claim 18, wherein said restraining means includes said gripper means grasped onto the sides of any said bag.

20. A bag filling machine as set forth in claim 16, including a powered auger in said powered supply means and rotatable to drive the powdery material into the bag.

21. A bag filling machine as set forth in claim 20, including a central hollow stem in said auger, and a vacuum probe insertable through said hollow stem into a bag being filled to aid in de-aeration of the powdery material in the bag being filled.

22. A bag filling machine comprising, a base, de-aeration means including a hopper on said base having capacity for powdery material sufficient for a given plurality of bags to be filled, a bulk storage unit, delivery means connected to move powdery material from said bulk storage unit to said hopper, said hopper having a vertical dimension sufficiently small to permit air to escape upwardly through the powdery material to de-aerate the powdery material therein in a predetermined time period, a bag filling station on said base, an outer clam shell spout at said bag filling station to receive a bag, and powered supply means connected to supply powdery material from said hopper to fill bags sequentially placed at said outer clam shell spout at a rate of said given plurality of bags in said predetermined time period.

23. A bag filling machine as set forth in claim 22, wherein said powered supply means includes a delivery screw to move material from said hopper to the bottom of a container at said bag filling station.

24. A bag filling machine as set forth in claim 22, including means to actuate said delivery means in accordance with actuation of said powered supply means to maintain said hopper approximately full.

25. A bag filling machine as set forth in claim 22, wherein said de-aeration means includes a second hopper disposed in said powered supply means at said bag filling station.

26. As bag filling machine as set forth in claim 25, wherein said powered supply means supplies powdery material to the bottom of said second hopper to force the powdery material upwardly into said second hopper.

* * * * *